US006831416B1

(12) United States Patent
Whyman

(10) Patent No.: US 6,831,416 B1
(45) Date of Patent: Dec. 14, 2004

(54) INDUCTIVE COMPENSATOR FOR MAGNETRON

(75) Inventor: Neil G. Whyman, Williamsport, PA (US)

(73) Assignee: L-3 Communications Corporation, San Carlos, CA (US)

( * ) Notice: Subject to any disclaimer, the term of this patent is extended or adjusted under 35 U.S.C. 154(b) by 0 days.

(21) Appl. No.: 10/701,561

(22) Filed: Nov. 6, 2003

(51) Int. Cl.[7] ..... H01J 25/50
(52) U.S. Cl. ..... 315/39.51; 315/39.67
(58) Field of Search ..... 315/39.51, 39.67, 315/42, 44

(56) References Cited

U.S. PATENT DOCUMENTS 5,635,797 A * 6/1997 Kitakaze et al. ..... 315/39.51
6,005,347 A * 12/1999 Lee ..... 315/39.63

* cited by examiner

*Primary Examiner*—David Vu
(74) *Attorney, Agent, or Firm*—Lowe Hauptman Gilman & Berner LLP.

(57) ABSTRACT

This invention is directed to crossed-field devices such as magnetrons to an inductive insert for a magnetron that compensates for the natural increase in cavity inductance with temperature which causes the output frequency to decline with increasing temperature.

15 Claims, 3 Drawing Sheets

INDUCTIVE COMPENSATOR FOR MAGNETRON

BACKGROUND OF THE INVENTION

1. Field of the Invention

The present invention relates to crossed-field devices such as magnetrons, and more particularly, to an inductive insert for a magnetron that compensates for the natural increase in cavity inductance with temperature which causes the output frequency to decline with increasing temperature.

2. Description of Related Art

Magnetrons are a type of crossed-field device that are commonly used to generate high power microwave energy for assorted applications, such as radar. A magnetron typically comprises a cylindrically shaped cathode that extends axially along a central axis of an anode structure comprising a plurality of anode vanes that extend radially from an annular anode ring. A space defined between the cathode surface and the anode structure provides an interaction region, and an electric potential is applied between the cathode and the anode forming a radial electric field in the interaction region. An axial magnetic field is provided in the interaction region in a direction perpendicular to the electric field by pole-pieces that focus magnetic flux from magnets disposed externally of the interaction region. The cathode may be provided with an internal heater disposed below the surface of the cathode to heat the cathode surface to a temperature sufficient to cause thermionic emission of electrons therefrom. The emitted electrons are caused to orbit around the cathode in the interaction region due to the resultant forces derived from the crossed electric and magnetic fields, during which they interact with an electromagnetic wave that is caused to move on the anode structure. The orbiting electrons give up energy to the electromagnetic wave, thus resulting in a high-power microwave electromagnetic wave circulating around the anode structure.

The anode structure comprises a plurality of resonant cavities. Each cavity is defined as the space bounded by the sides of adjacent vanes, the corresponding inner surface of the anode ring and the exterior of the interaction region. In the desired mode of operation, alternate anode vanes are at the same RF potential. Accordingly, the anode structure of magnetrons of the "Vane and Strap" type further include straps that respectively couple alternating ones of the anode vanes to keep them at the same RF potential. Other types of magnetrons exist that do not use straps.

In order to put the high-power microwaves to use, an output circuit is provided to couple into the electric or magnetic (or both) fields that are supported on the anode structure and associated cavities. The output circuit can itself be coupled to a transmission system which takes the energy to the point of use. A typical transmission system includes waveguide. A typical output circuit includes a wire loop disposed in one of the cavities of the anode defined between adjacent anode vanes.

In the absence of any compensation, the natural increase in cavity inductance with temperature (in conjunction with several other less significant effects) causes the magnetron's output frequency to decline with increasing temperature: the rate of decline is referred to as the temperature coefficient. This coefficient is always negative for an uncompensated magnetron and is principally derived from the thermal expansion coefficients of the materials used in the cavity walls (typically the anode ring and vanes).

SUMMARY OF THE INVENTION

In accordance with the teachings of the present invention, the rate of change of cavity inductance versus temperature (and by reference the temperature coefficient) can be selected at the design stage. Hence, this invention enables magnetrons to be designed with a wide range of rates of change of cavity inductance. Potentially, using this invention in any particular magnetron, the rate of change of cavity inductance can be made to both increase over that of the uncompensated magnetron or to decrease, even to the extent of becoming negative (i.e., where the cavity inductance actually reduces with increasing temperature).

The invention provides the capability of selecting the rate of change of inductance to be negative with increasing temperature which means that the temperature coefficient of frequency of the entire magnetron can be reduced below levels achieved by current design techniques to substantially zero. In other words by over-compensating the cavity inductance the change in cavity inductance and the other frequency-lowering effects can be entirely counteracted. One such other frequency-lowering effect would be a permanent magnet's temporary loss of magnetic field strength as temperature increases because a lower magnetic field strength often causes the output frequency of the magnetron to drop.

The invention comprises inductive inserts within the cavities of a magnetron oscillator. The metals from which the cavity and inserts are made, and their volumes, can be selected to cause the natural increase of cavity inductance with increasing temperature to be reduced, nullified and even reversed without any manual manipulation. The selection of the materials depends on the value of the coefficient of thermal expansion.

These and other objects of the present invention are achieved by a microwave source including a magnetron that has an anode ring concentrically disposed around and spaced from a cathode. The anode ring includes a plurality of anode vanes with cavities being defined between adjacent ones of the plurality of anode vanes. The cavities have inductive inserts selected such that the rate of change of cavity inductance is compensated as temperature varies. The inductive inserts are themselves thermally and mechanically attached to the anode structure.

Still other objects and advantages of the invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description thereof are to be regarded as illustrative in nature, and not as restrictive. In particular the present invention is not limited by the particular shape of the insert, nor by the number per cavity, the present invention relates to the thermal coefficients of expansion of materials chosen and the volume of each cavity and the total volume of all inductive inserts per cavity. The accompanying figures and description of the preferred embodiment show two inserts per cavity that are supported at one axial end in a "vane and strap" style magnetron with a loop-style output coupling element; the present invention is not limited to inserts of the shape shown; the present invention is not limited to two inserts per cavity; the present invention is not limited by the method of supporting the insert; the present invention is not limited to "vane and strap" style magnetrons; the present invention is not limited by the type of output circuit or output coupling element; the present invention is not limited by the transmission system.

BRIEF DESCRIPTION OF THE DRAWINGS

The present invention is illustrated by way of example, and not by limitation, in the figures of the accompanying drawings, wherein elements having the same reference numeral designations represent like elements throughout and wherein.

DETAILED DESCRIPTION OF THE PREFERRED EMBODIMENT

Figure 1A:
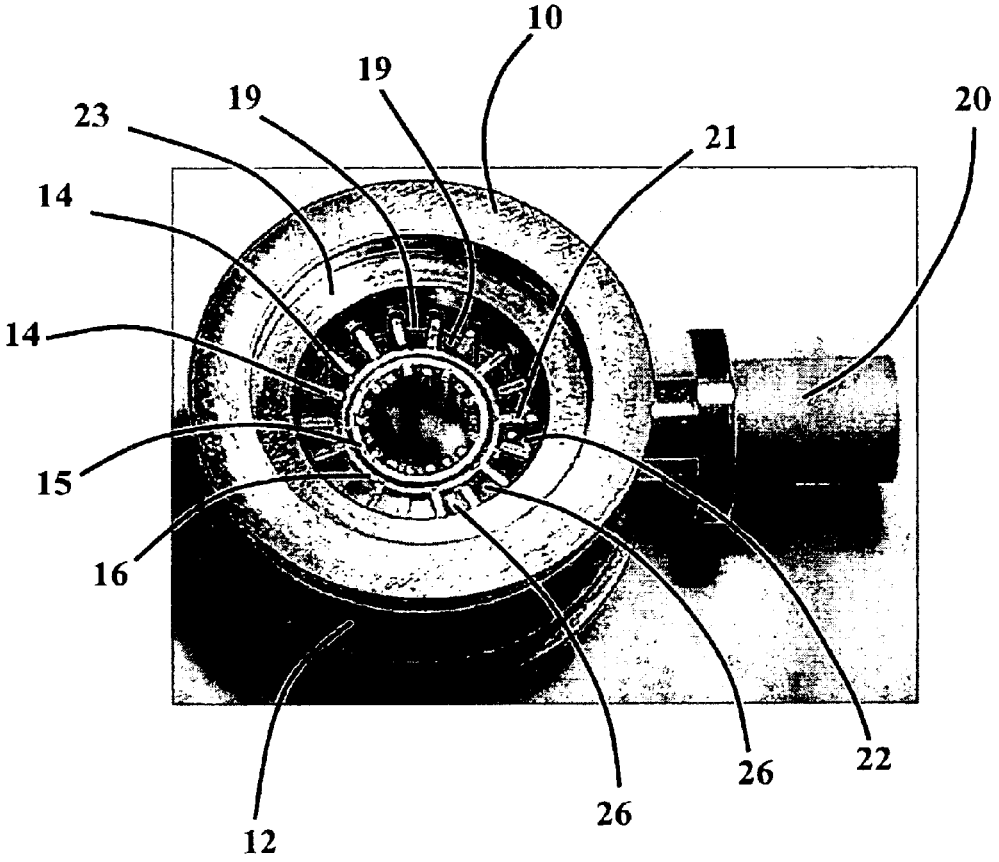
FIG. 1A is a top perspective view of the magnetron system.
Figure 1B:
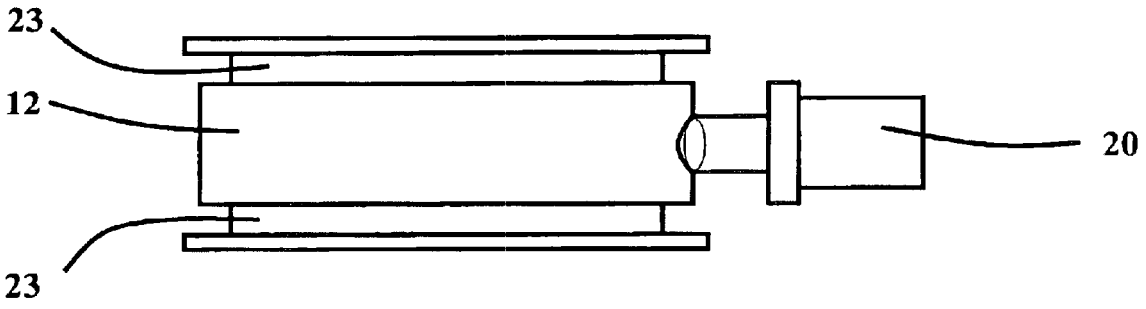
FIG. 1B is a side elevation view of FIG. 1A.

For purposes of convenience, terms such as "upwardly", "left", "right", etc., are used herein and should be construed in the relative sense. Referring first to FIGS. 1A and 1B, an exemplary magnetron 10 coupled to an output circuit 20 is illustrated. For clarity, the cathode and pole-pieces are not shown. The anode ring 12 has a plurality of vanes 14 extending radially inwardly. In the desired mode of operation, alternate anode vanes 14 are at the same RF potential. Accordingly, the magnetron 10 further includes straps that respectively couple alternating ones of the anode vanes 14 to keep the anode vanes 14 at the same RF potential and maintain separation between the frequencies of the $\pi$ and $\pi-1$ modes of operation. One set of alternating vanes are connected to the inner strap 15 and the other set of alternating vanes are connected to the outer strap 16. One of the vanes 21 is provided with a cut-out to facilitate the insertion of the output circuit's output coupling element 22 into the anode structure. Two supports 23 are provided for the thermal and mechanical connection of the inductive inserts 19 to the anode ring 12. One support 23 is on each vertical side of anode ring 12. Each support 23 carries one inductive insert 19 per cavity 26.

Figure 2:
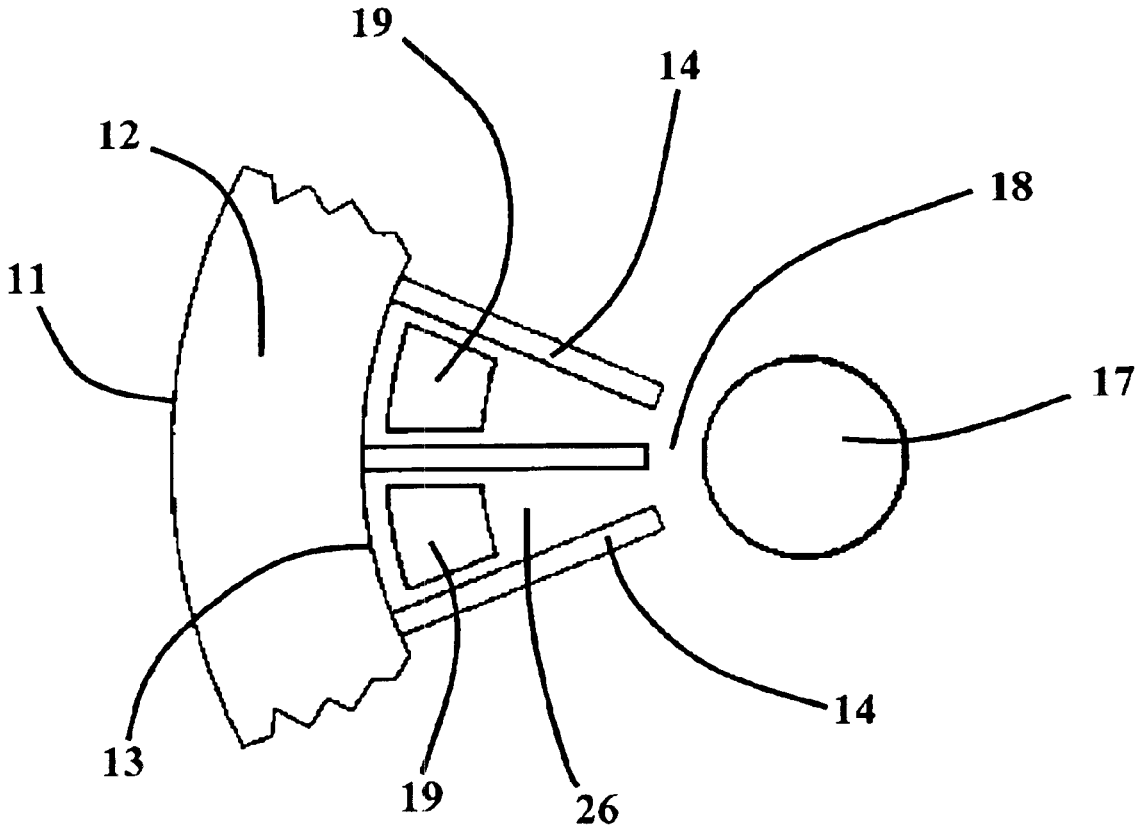
FIG. 2 is a sectional plan view of a segment of the anode structure comprising two adjacent cavities with inductive inserts in place, and showing the cathode and interaction region.

Referring to FIG. 2, for clarity the line of sectioning has been set below the level of the straps but above the gap between the two inductive inserts that enter the cavities from opposite ends. The cylindrical cathode 17 lies at the axis of the magnetron. A cylindrical anode ring 12 made of molybdenum having an inner surface 13 and an outer surface 11 surrounds the cathode 17. Vanes 14 made of molybdenum extend radially inward from the inner surface of the anode ring 13. An interaction region 18 exists between the cathode 17 and the nearer ends of the vanes 14. As known in the art, the spaces bounded by the sides of adjacent vanes 14 the corresponding inner surface of the anode ring 13 and the interaction region 18 define the cavities 26 of the magnetron. Inductive inserts 19 made of copper are positioned in the wider ends of the cavities 26 and are thermally and mechanically connected to the anode ring 12 by their supports 23.

Figure 3:
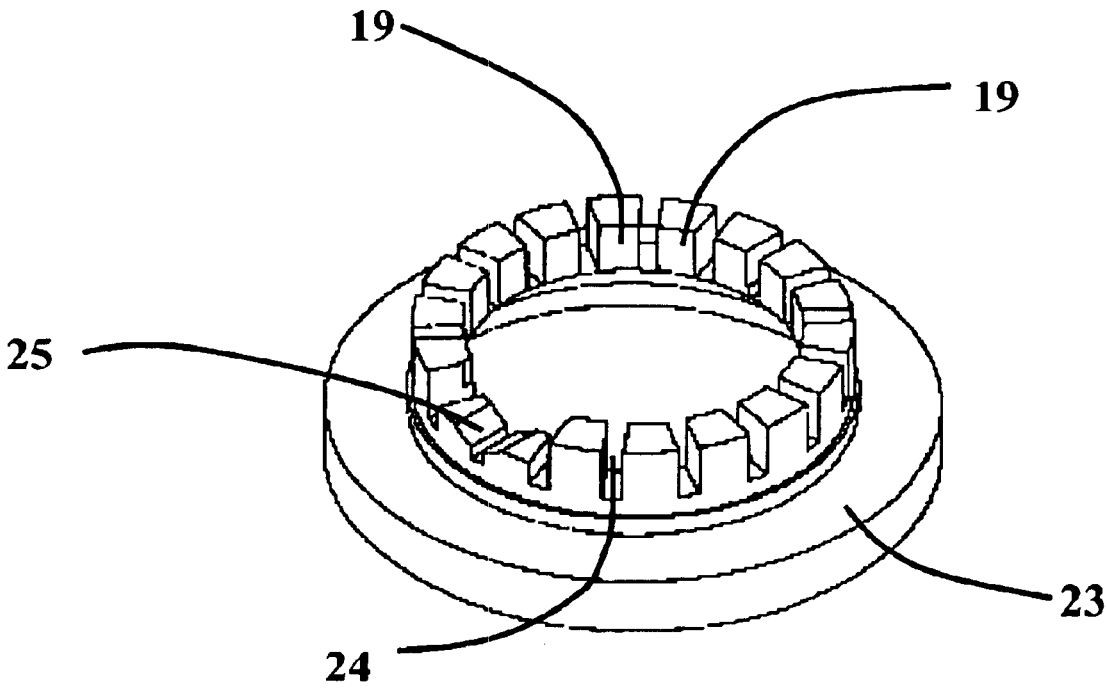
FIG. 3 is a perspective view of inductive inserts and their support used in the magnetron of FIG. 1 according to the present invention.

FIG. 3 illustrates an assembly of one of the supports and one set of inductive inserts. It comprises a broad copper annulus 23 from which the individual inductive inserts 19 extend axially. The individual inductive inserts are separated by gaps 24 that ultimately have the anode vanes passing through them. One pair of adjacent inductive inserts are reduced in size to provide a space 25 by which the output coupling element 22 can penetrate into the cavities from which it extracts power.

It should be appreciated by persons skilled in the art that an operational magnetron would further comprise additional elements, such as a magnet and magnetic pole-pieces arranged to couple magnetic flux to the interaction region 18. These and other known aspects of the magnetron have been omitted herein for ease of illustration and description. It will be appreciated by those skilled in the art that the absence of any of the magnetic elements of the magnetron from the figures indicates that the present invention's effect on the rate of change of cavity inductance with temperature is entirely independent of the magnetic circuit chosen for the magnetron. An example of a conventional magnetron showing such known aspects is provided in U.S. Pat. No. 5,894,199, which is incorporated by reference herein.

It will also be appreciated by persons skilled in the art that the present invention's effect on the rate of change of cavity inductance with temperature is not dependant on the output circuit and output coupling element provided that account is taken of the volume of insert that may need to be omitted to make space for the output coupling element. A working magnetron has been made incorporating the present invention and has a measured temperature coefficient of −11 kHz/° C. The equivalent magnetron without the present invention has previously been built and had a measured temperature coefficient of −62 kHz/° C. The invention was solely responsible for the greater than five-fold reduction in the temperature coefficient.

It will be readily seen by one of ordinary skill in the art that the present invention fulfills all of the objects set forth above. After reading the foregoing specification, one of ordinary skill will be able to affect various changes, substitutions of equivalents and various other aspects of the invention as broadly disclosed herein. It is therefore intended that the protection granted hereon be limited only by the definition contained in the appended claims and equivalents thereof.

What is claimed is:

1. A microwave source, comprising:

a magnetron having an anode ring concentrically disposed around and spaced from a cathode, said anode ring further comprising a plurality of anode vanes with cavities being defined between adjacent ones of the plurality of anode vanes, said cavities having an inductive insert selected such that the rate of change of cavity inductance is compensated for as temperature increases.

2. The microwave source of claim 1, wherein the volume of said cavity can be selected such that the rate of change of cavity inductance is minimized as temperature increases.

3. The microwave source of claim 1, wherein an outer body portion of said anode has a substantially cylindrical shape.

4. The microwave source of claim 1, wherein said microwave source further comprises an end portion providing an antenna for communication of said high power microwave signal therefrom.

5. The microwave source of claim 1, wherein said anode has an annular ring formed of a first material and the inductive insert formed of a second material.

6. The microwave source of claim 5, wherein said inductive inserts are adjacent said anode vanes.

7. The microwave source of claim 1, wherein said plurality of anode vanes radially extend inwardly.

8. The microwave source of claim 1, wherein one of said plurality of anode vanes form an output vane.

9. The microwave source of claim 8, wherein each insert has a curved surface opposite an adjacent output vane.

10. The microwave source of claim 1, wherein said inductive inserts are thermally and mechanically fastened to the anode ring.

11. The microwave source of claim 10, wherein said inductive inserts extend upwardly from a support.

12. The microwave source of claim 1, wherein materials are selected for said anode and said inductive inserts based on thermal expansion coefficients.

13. The microwave source of claim 12, wherein a cavity is formed by said vanes, and said anode ring and said inductive insert such that said inductive inserts can be selected to compensate for volume changes in the cavity due to thermal expansion of said vanes and said anode ring.

14. The microwave source of claim 1, wherein said anode is made of molybdenum.

15. The microwave source of claim 1, wherein said inductive inserts are made of copper.

* * * * *